US007395703B2

(12) United States Patent
Niemeyer et al.

(10) Patent No.: US 7,395,703 B2
(45) Date of Patent: Jul. 8, 2008

(54) FORMATION TESTING APPARATUS AND METHOD FOR SMOOTH DRAW DOWN

(75) Inventors: Eick Niemeyer, Hannover (DE); Tobias Kischkat, Celle (DE); Matthias Meister, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 288 days.

(21) Appl. No.: 10/782,006

(22) Filed: Feb. 19, 2004

(65) Prior Publication Data

US 2004/0231841 A1 Nov. 25, 2004

Related U.S. Application Data

(63) Continuation-in-part of application No. 10/423,420, filed on Apr. 25, 2003, now Pat. No. 7,011,155, which is a continuation-in-part of application No. 09/910,624, filed on Jul. 20, 2001, now Pat. No. 6,568,487, and a continuation-in-part of application No. 09/910,209, filed on Jul. 20, 2001, now Pat. No. 6,609,568.

(51) Int. Cl.
*E21B 49/10* (2006.01)

(52) U.S. Cl. ..... 73/152.24

(58) Field of Classification Search ..... 73/152.24, 73/152.27

See application file for complete search history.

(56) References Cited

U.S. PATENT DOCUMENTS

| | | | | |
|---|---|---|---|---|
| 3,321,965 | A | 5/1967 | Johnson et al. | 73/155 |
| 4,287,946 | A | 9/1981 | Brieger | 166/100 |
| 4,416,152 | A | 11/1983 | Wilson | 73/152.26 |
| 4,483,187 | A | 11/1984 | Maddock, Jr. et al. | 73/152.29 |
| 4,745,802 | A | 5/1988 | Purfurst | 73/152.26 |
| 4,860,580 | A | 8/1989 | DuRocher | 73/152.26 |
| 4,951,749 | A | 8/1990 | Carroll | 166/264 |
| 5,233,866 | A | 8/1993 | Desbrandes | 73/155 |
| 5,587,525 | A | 12/1996 | Shwe et al. | 73/15.52 |
| 5,644,076 | A | 7/1997 | Proett et al. | 73/152.41 |
| 5,703,286 | A | 12/1997 | Proett et al. | 73/152.05 |
| 5,708,204 | A | 1/1998 | Kasap | 73/152.52 |
| 5,803,186 | A | 9/1998 | Meister et al. | 175/50 |
| 6,047,239 | A | 4/2000 | Berger et al. | 702/9 |
| 6,871,713 | B2 * | 3/2005 | Meister et al. | 175/50 |
| 6,964,301 | B2 * | 11/2005 | Hill et al. | 166/264 |
| 2004/0026125 | A1 * | 2/2004 | Meister et al. | 175/50 |
| 2004/0231842 | A1 * | 11/2004 | Shammai et al. | 166/264 |

FOREIGN PATENT DOCUMENTS

| | | | |
|---|---|---|---|
| EP | 0490421 | A1 | 6/1992 |
| EP | 0520903 | A2 | 12/1992 |
| EP | 0698722 | A2 | 2/1996 |

* cited by examiner

*Primary Examiner*—Hezron E. Williams
*Assistant Examiner*—John Fitzgerald
(74) *Attorney, Agent, or Firm*—Madan, Mossman & Sriram, PC

(57) ABSTRACT

A method and apparatus for of determining a formation parameter of interest. The method includes placing a tool into communication with the formation to test the formation and drawing down a test volume at an increasing draw rate during a first draw period and decreasing the draw rate during a second draw period to create a smooth draw down cycle. The draw down can be step-wise or continuous. The formation parameter is determined using formation rate analyis and characteristics determined during the draw down cycle.

42 Claims, 8 Drawing Sheets

FORMATION TESTING APPARATUS AND METHOD FOR SMOOTH DRAW DOWN

CROSS REFERENCE TO RELATED APPLICATIONS

The present application is a continuation-in-part of U.S. patent application Ser. No. 10/423,420 for "Formation Testing Apparatus and Method for Optimizing Draw Down" filed on Apr. 25, 2003 now U.S. Pat. No. 7,011,155, which is a continuation-in-part of U.S. patent application Ser. No. 09/910,624 for "Procedure for Fast and Extensive Formation Evaluation with Minimum System Volume" filed on Jul. 20, 2001 now U.S. Pat. No. 6,568,487 and is further a continuation-in-part of U.S. patent application Ser. No. 09/910,209 for "Closed-Loop Drawdown Apparatus and Method for In-situ Analysis of Formation Fluids" filed on Jul. 20, 2001 now U.S. Pat. No. 6,609,568. The specification of each above-identified application is incorporated herein by reference.

BACKGROUND OF THE INVENTION

1. Field of the Invention

This invention generally relates to the testing of underground formations or reservoirs. More particularly, this invention relates to a method and apparatus for real-time closed-loop control of a draw down system.

2. Description of the Related Art

To obtain hydrocarbons such as oil and gas, well boreholes are drilled by rotating a drill bit attached at a drill string end. The drill string may be a jointed rotatable pipe or a coiled tube. A large portion of the current drilling activity involves directional drilling, i.e., drilling boreholes deviated from vertical and/or horizontal boreholes, to increase the hydrocarbon production and/or to withdraw additional hydrocarbons from earth formations. Modern directional drilling systems generally employ a drill string having a bottom hole assembly (BHA) and a drill bit at an end thereof that is rotated by a drill motor (mud motor) and/or the drill string. A number of down hole devices placed in close proximity to the drill bit measure certain down hole operating parameters associated with the drill string. Such devices typically include sensors for measuring down hole temperature and pressure, azimuth and inclination measuring devices and a resistivity-measuring device to determine the presence of hydrocarbons and water. Additional down hole instruments, known as measurement-while-drilling (MWD) or logging-while-drilling (LWD) tools, are frequently attached to the drill string to determine formation geology and formation fluid conditions during the drilling operations.

One type of while-drilling test involves producing fluid from the reservoir, collecting samples, shutting-in the well, reducing a test volume pressure, and allowing the pressure to build-up to a static level. This sequence may be repeated several times at several different reservoirs within a given borehole or at several points in a single reservoir. This type of test is known as a "Pressure Build-up Test." One important aspect of data collected during such a Pressure Build-up Test is the pressure build-up information gathered after drawing down the pressure in the test volume. From this data, information can be derived as to permeability and size of the reservoir. Moreover, actual samples of the reservoir fluid can be obtained and tested to gather Pressure-Volume-Temperature data relevant to the reservoir's hydrocarbon distribution.

Some systems require retrieval of the drill string from the borehole to perform pressure testing. The drill string is removed, and a pressure measuring tool is run into the borehole using a wireline tool having packers for isolating the reservoir. Although wireline conveyed tools are capable of testing a reservoir, it is difficult to convey a wireline tool in a deviated borehole.

A more recent MWD system is disclosed in U.S. Pat. No. 5,803,186 to Berger et al. The '186 patent provides a MWD system that includes use of pressure and resistivity sensors with the MWD system, to allow for real time data transmission of those measurements. The '186 device enables obtaining static pressures, pressure build-ups, and pressure draw-downs with a work string, such as a drill string, in place. Also, computation of permeability and other reservoir parameters based on the pressure measurements can be accomplished without removing the drill string from the borehole.

Using a device as described in the '186 patent, density of the drilling fluid is calculated during drilling to adjust drilling efficiency while maintaining safety. The density calculation is based upon the desired relationship between the weight of the drilling mud column and the predicted down hole pressures to be encountered. After a test is taken a new prediction is made, the mud density is adjusted as required and the bit advances until another test is taken.

A drawback of this type of tool is encountered when different formations are penetrated during drilling. The pressure can change significantly from one formation to the next and in short distances due to different formation compositions. If formation pressure is lower than expected, the pressure from the mud column may cause unnecessary damage to the formation. If the formation pressure is higher than expected, a pressure kick could result.

Such formation pressure testing can be hampered by a variety of factors including insufficient draw down volume, tool or formation plugging during a test, seal failure, or pressure supercharging. These factors can result in false pressure information. Pressure tests with excessive draw rate, i.e. the rate of volume increase in the system, or tests with an insufficient draw volume should be avoided. The excessive draw rate often results in an excessive delta pressure drop between the test volume and the formation causing long build up times. Moreover, compressibility of fluid in the tool will dominate the pressure response if the formation cannot provide enough fluid for the excessive pressure drop. With an excessive draw rate the pressure drop can exceed the fluid bubble point thereby causing gas to evolve from the fluid and corrupt the test result.

With insufficient draw down volume pressure in the tool will not fall below the formation pressure resulting in little or no pressure build up. In very permeable formations, insufficient draw down volume can falsely indicate a tight formation.

Pressure supercharging, or simply supercharging, exists when pressure at the sandface near the borehole wall is greater than the true formation pressure. Supercharging is caused by fluid invasion from the drilling process that has not completely dissipated into the formation. Supercharging is also caused by annulus fluid pressure bypassing a seal through the mudcake. Consequently, measured pressure information is typically measured more than once to provide verification of the information.

The typical verification test involves multiple draw down tests where using identical draw down parameters, e.g. draw rate, delta pressure and test duration. In some cases, the parameters might be varied according to a predetermined verification protocol. The multiple draw test using the same test parameters suffers from inefficiency of time and the possibility of repeating erroneous results. Merely following a predetermined test protocol does not increase efficiency, because the protocol might not address real-time conditions in a timely manner. Furthermore, predetermined protocols will not necessarily verify previous test results.

A common practice is to set a fixed draw down rate, also referred to as draw rate. Setting a fixed draw rate results in an uncontrolled transition from zero rate to the set fixed draw rate. The common tool also instantaneously halts the draw portion of the test after a predetermined time period, thereby creating another uncontrolled transition from the fixed rate back to zero, these uncontrolled transitions result in discontinuities at the transition points, which are not well followed by test equipment and sensors, particularly pressure sensors used in down hole applications.

The combination of discontinuities created by current test procedures coupled with the typical sensor response results in several deficiencies. The pressure sensor output signal will typically lag behind the actual pressure existing in the test volume. Sometimes the pressure sensor will "overshoot" by indicating a pressure beyond (higher or lower) than the actual limit pressure. The abrupt transitions will also alter the test environment causing erroneous pressure measurements. The transition points result in a relatively quick pressure change causing a temperature change. When there is a high pressure gradient, the temperature change will be even greater resulting in poor temperature equalization, which will lead to incorrect pressure measurements with the typical temperature-compensated pressure sensors. When these deficiencies are present, analytical methods of determining formation parameters such as pressure, mobility and compressibility are inaccurate, and even direct measurement of formation pressure is inaccurate.

Any of the above identified problems can lead to false information regarding formation properties and to wasted rig time. Therefore, there is a need to provide a method and apparatus for performing multiple verification tests without operator intervention. Furthermore, there is a need to provide an apparatus and method for a smooth transition from a zero draw-rate to a set maximum draw-rate and then for a smooth transition back to zero draw rate.

SUMMARY OF THE INVENTION

The present invention addresses some of the drawbacks discussed above by providing a closed-loop measurement while drilling apparatus and method for initiating a draw down cycle with a smooth transition from a zero draw rate to a predetermined maximum draw rate and then a smooth transition from the maximum draw rate back to zero.

One aspect of the present invention provides a method for determining a parameter of interest of a formation. The method comprises conveying a tool into a well borehole traversing a formation and placing the tool into fluid communication with the formation. Formation fluid is drawn into a test volume by decreasing pressure in the test volume at an increasing draw rate during a first draw portion. A first formation or tool characteristic is determined during the first draw portion, the characteristic being indicative of the formation parameter of interest.

The draw down rate is controlled as a continuously increasing rate during the first draw portion and/or in a step-wise increasing manner. A second draw portion includes decreasing the draw rate during the second draw portion either continuously and/or in a step-wise decreasing manner.

In one method according to the present invention, a quality factor or indicator can be assigned to any portion of the test, where the quality indicator is determined from a formation rate analysis. The quality indicator is a correlation of flow rates to pressure, which correlation is represented by a straight line equation. Extrapolation can then be used to determine and/or verify formation pressure.

Another aspect of the present invention provides an apparatus for determining a desired formation parameter of interest. The apparatus includes a tool conveyable into a well borehole traversing a formation a test unit in the tool is adapted for fluid communication with the formation, the test unit including a test volume for receiving fluid from the formation. A control device is associated with the test volume for controlling pressure in the test volume decreasing pressure in the test volume using an increasing rate during a first draw portion, and a sensing device is used for determining a first characteristic of the test volume during the first draw portion, the determined first characteristic being indicative of the formation parameter of interest.

The tool can be conveyed on a drill string, coiled tube or wireline. The test can be a small-volume test or a large volume pressure test such as a drill stem test. The control device can be a variable rate pump to draw fluid from the test volume or the control device can be a controllable piston associated with the test volume to change the vary the test volume.

A downhole or surface controller can be used to control the control device. A processor receives an output from the sensing device and processes the output using formation rate analysis.

In one embodiment, the test unit and controller operate closed-loop and autonomously after the test is initiated. The tool is conveyed down hole on a work string (drill string or wireline) and is placed in communication with the formation to test the formation.

In yet another aspect of the present invention is a system for determining in situ a desired formation parameter of interest. The system includes a work string for conveying a tool into a well borehole traversing a formation and a test unit in the tool, the test unit being adapted for fluid communication with the formation, the test unit including a test volume for receiving fluid from the formation. A control device is associated with the test volume for controlling pressure in the test volume decreasing pressure in the test volume using an increasing rate during a first draw portion. A sensing device determines a first characteristic of the test volume during the first draw portion, the determined first characteristic being indicative of the formation parameter of interest. A processor receives an output of the sensing device, the processor processing the received output according to programmed instructions, the formation parameter of interest being determined at least in part by the processed output.

BRIEF DESCRIPTION OF THE DRAWINGS

The novel features of this invention, as well as the invention itself, will be best understood from the attached drawings, taken along with the following description, in which similar reference characters refer to similar parts and wherein.

DESCRIPTION OF THE PREFERRED EMBODIMENT

Figure 1A:
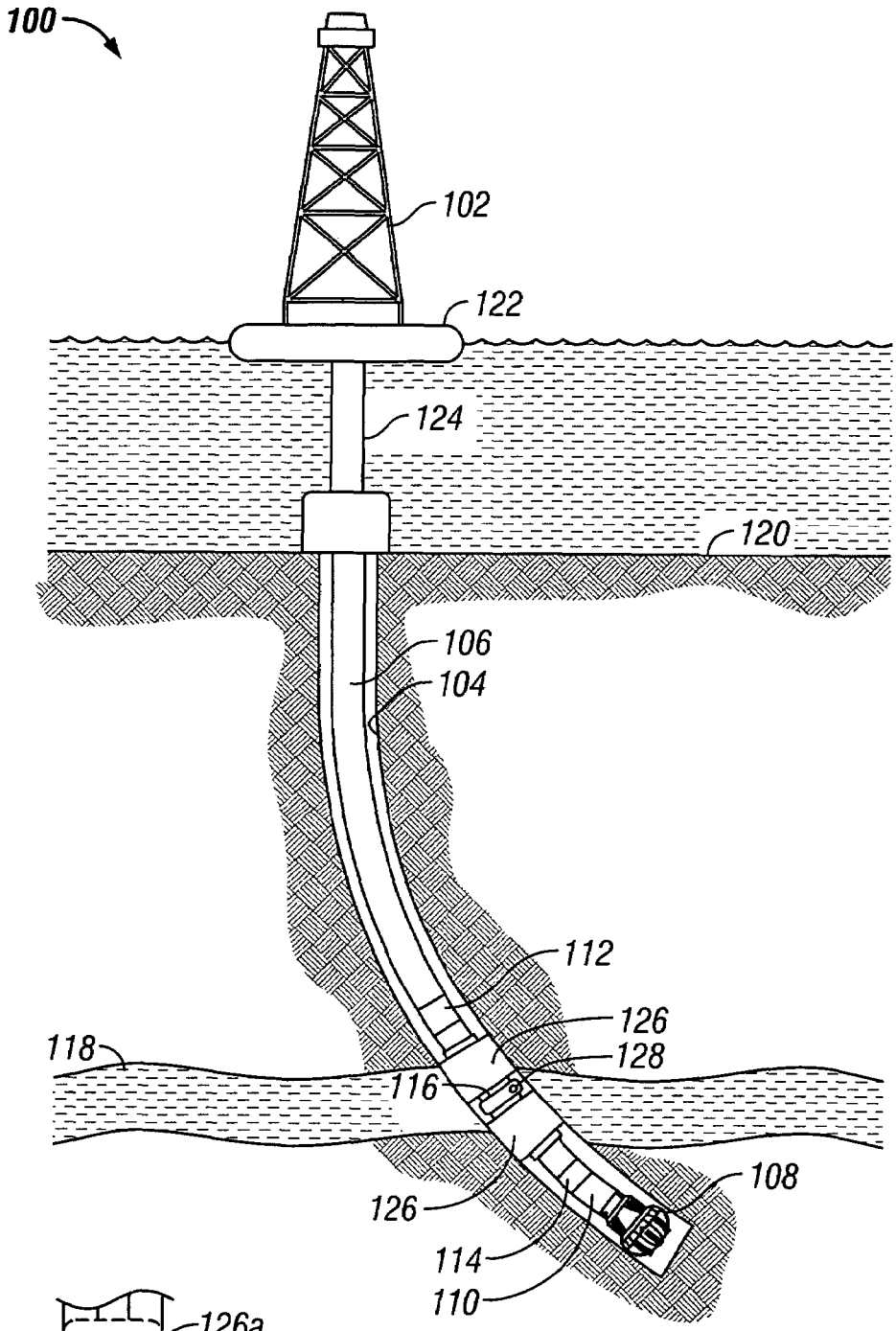
FIG. 1A is an elevation view of an offshore drilling system according to one embodiment of the present invention.

FIG. 1A is a drilling apparatus 100 according to one embodiment of the present invention. A typical drilling rig 102 with a borehole 104 extending therefrom is illustrated, as is well understood by those of ordinary skill in the art. The drilling rig 102 has a work string 106, which in the embodiment shown is a drill string. The drill string 106 has attached thereto a drill bit 108 for drilling the borehole 104. The present invention is also useful in other types of work strings, and it is useful with a wireline, jointed tubing, coiled tubing, or other small diameter work string such as snubbing pipe. The drilling rig 102 is shown positioned on a drilling ship 122 with a riser 124 extending from the drilling ship 122 to the sea floor 120. However, any drilling rig configuration such as a land-based rig or a wireline may be adapted to implement the present invention.

Figure 1B:
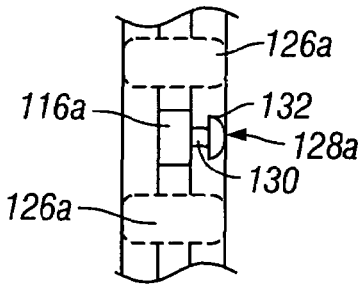
FIG. 1B shown an alternative embodiment of the test apparatus in FIG. 1A.

If applicable, the drill string 106 can have a down hole drill motor 110. Incorporated in the drill string 106 above the drill bit 108 is a typical testing unit, which can have at least one sensor 114 to sense down hole characteristics of the borehole, the bit, and the reservoir, with such sensors being well known in the art. A useful application of the sensor 114 is to determine direction, azimuth and orientation of the drill string 106 using an accelerometer or similar sensor. The BHA also contains a formation test apparatus 116. The test apparatus 116 preferably includes a sealing device 126 and port 128 to provide fluidic communication with an underground formation 118. The seal 126 can be known expandable packers as shown, or as shown in FIG. 1B, the seal 126 can be a pad 132 on an extendable probe 130 where the extendable probe 130 is part of a test apparatus 116*a*. It is also contemplated and within the scope of the present invention to include an extendable probe 130, with or without a pad seal 132, in the test apparatus 116*a* to extend and contact the formation below one packer 126*a* or between a pair of packers 126*a*. The packers 126*a* are shown in dashed form to indicate that the packers are desirable but optional when the test apparatus 116*a* includes an extendable probe 130 with a pad seal 132. Extendable probes with sealing pads are known, and do not require further illustration here. The test device 116/116*a* will be described in greater detail with respect to FIG. 2. A telemetry system 112 is located in a suitable location on the work string 106 such as above the test apparatus 116. The telemetry system 112 is used for command and data communication between the surface and the test apparatus 116.

Figure 2:
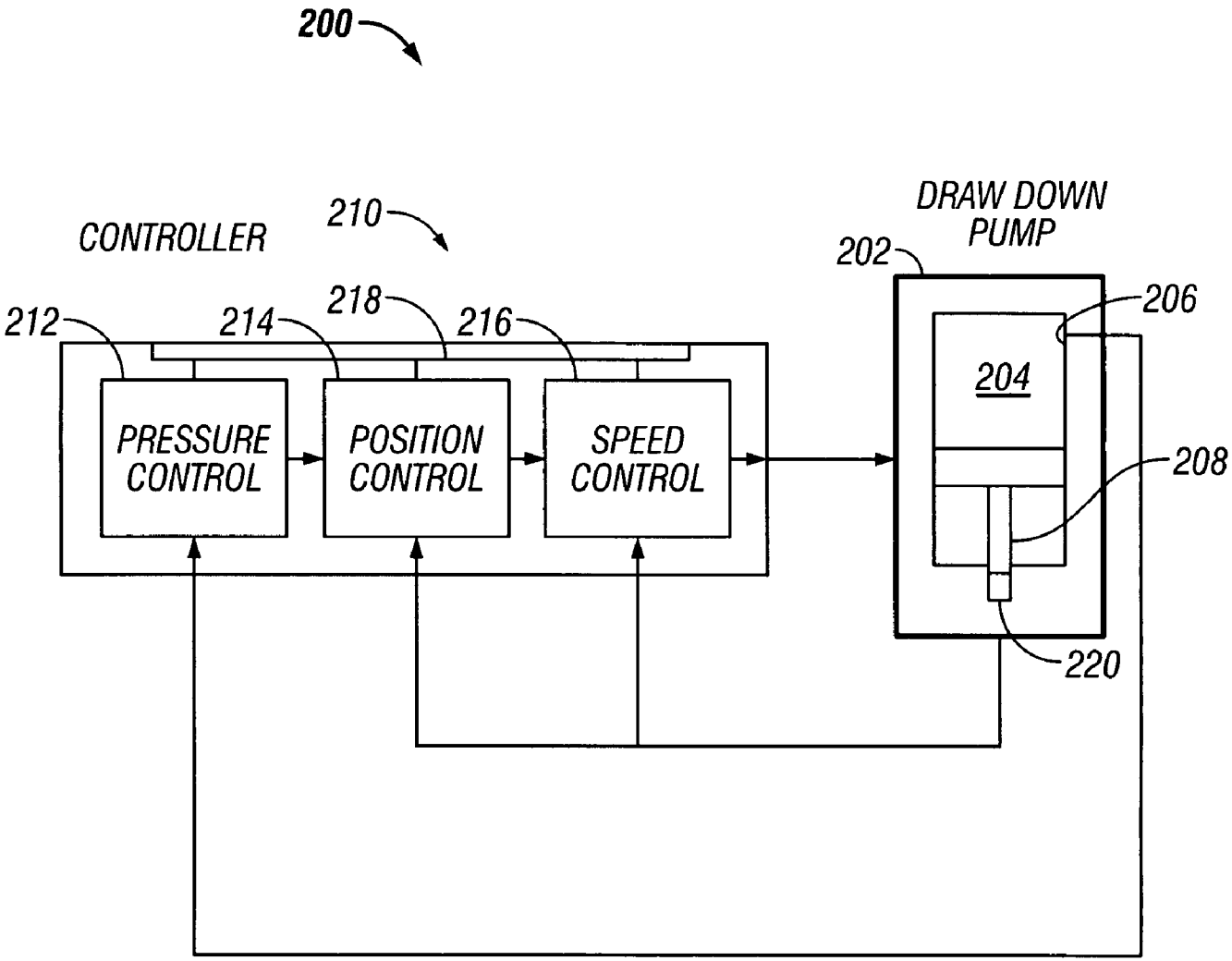
FIG. 2 shows a draw down unit and closed-loop control according to the present invention.

FIG. 2 illustrates a test device with closed loop control according to the present invention. The device 200 includes draw down unit 202 having a test volume 204 and a member 208 for controlling volume of the test volume. A sensor 206 is associated with the test volume to measure characteristics of fluid in the volume.

The test volume 204 is preferably integral to a flow line in fluidic communication with the formation. Such a device minimizes the overall system volume, which provides more responsiveness to formation influence, e.g., pressure response. The volume, however, need not be limited to a small volume. For example, the methods associated with the present invention are useful in drill stem testing, which typically includes a large system volume.

The volume control member 208 is preferably a piston, but can be any other useful device for changing a test volume. Alternatively, the member can be a pump or other mover to reduce pressure within the test volume 204.

The sensor 206 is preferably a quartz pressure sensor. The sensor, however, might alternatively be or further include other sensors as desired. Other sensors that might be of use in variations of the methods described herein might include temperature sensors, flow sensors, nuclear detectors, optical sensors, resistivity sensors, or other known sensors to measure characteristics of the volume 204.

The device further includes a controller 210 for controlling the test unit 202. The controller preferably includes a microprocessor 218 and circuitry for piston (or pump) pressure control 212, position control 214, and speed control 216. One or more sensors 220, 206 associated with the draw down system are used to send signals to the controller to provide closed loop control.

The test device 200 performs the formation pressure test within a brief drilling pause of about five minutes, which is the time needed to add another drill pipe when the device is incorporated into a drilling BHA. This short test period reduces the risk of differential sticking during drilling through a depleted reservoir section where the drilling process should not be interrupted for an extended time with the BHA stationary in the hole.

The controller 210 includes storage for processed data and for programs to conduct data processing down hole. The programs for determining formation parameters from the measured values are used in conjunction with the pump control circuits to provide closed loop control for position, speed, and pressure control.

For pressure measurements a high accuracy quartz pressure gauge 206 is preferred for its good resolution. Less preferred pressure sensors that could also be used are strain gauge or piezoelectric resistive transducers. In a preferred embodiment, the pressure transducer is disposed very close to a pad sealing element 132. Such a sensor placement overcomes problems experienced in wireline measurements that lack accuracy when gas is accumulated in the flow line.

Preferably, the tool includes sufficient electronic memory to store up to 200 or more test results for further detailed post-run analysis after the data are dumped at the surface. With these data a logging engineer might further interpret the pressure data and correlate them to the geology and pressure measurements from neighboring wells.

To control the formation test tool down hole, initiation signals are sent from the surface to the tool utilizing standard mud pulse telemetry. The down hole controller is preferably programmed to perform a test according to the present invention to be described in detail later. The expected overbalance and mobility are preferably programmed for a particular well to further accelerate the optimization process and, therefore, decrease the overall measurement time.

When the test begins, the tool preferably operates in an autonomous mode to perform the test independently. The tool can be shut down as an emergency function by cycling mud pumps to signal a command to stop the measurement process.

A preferred test in a horizontal well application begins with a tool face measurement to provide an indication that the pad sealing element is not pushed downwards against the formation where the cutting bed is located. Such an orientation would likely result in an inability to seal or in tool plugging. If the pad sealing element is pointing downwards, the actual position is transmitted to the surface to allow a new orientation of the tool by rotating the tool from the surface.

Once the tool is oriented properly, the pad sealing element is pushed against the borehole wall in a controlled manner. The sealing pressure is continuously monitored until effective sealing is achieved. A small pressure increase of the internal system volume measured by the quartz gauge indicates a good seal.

Depending on the test option selected, the tool begins its pressure measurement process. The tool releases the pad sealing element from the borehole wall and transmits the measured data to the surface via mud pulse telemetry after completion of each test or series of tests as desired. At the surface the following data are preferably made available: two annular pressures (before and after the test), up to three or more formation pressures of the individual pressure tests, drawdown pressures of the first two tests, the mobility value calculated from the last test, and a quality indicator from the correlation factor when formation rate methods are used.

Thus, data are directly available immediately after each test or series of tests and can be utilized for the further planning of the borehole. By providing repeat measurements, the pressure data can be compared from just one pressure measurement. This provides high confidence in the pressure test since errors in the pressure measurement process due to leaking or other effects can be observed directly in varying pressure data.

Figure 3:
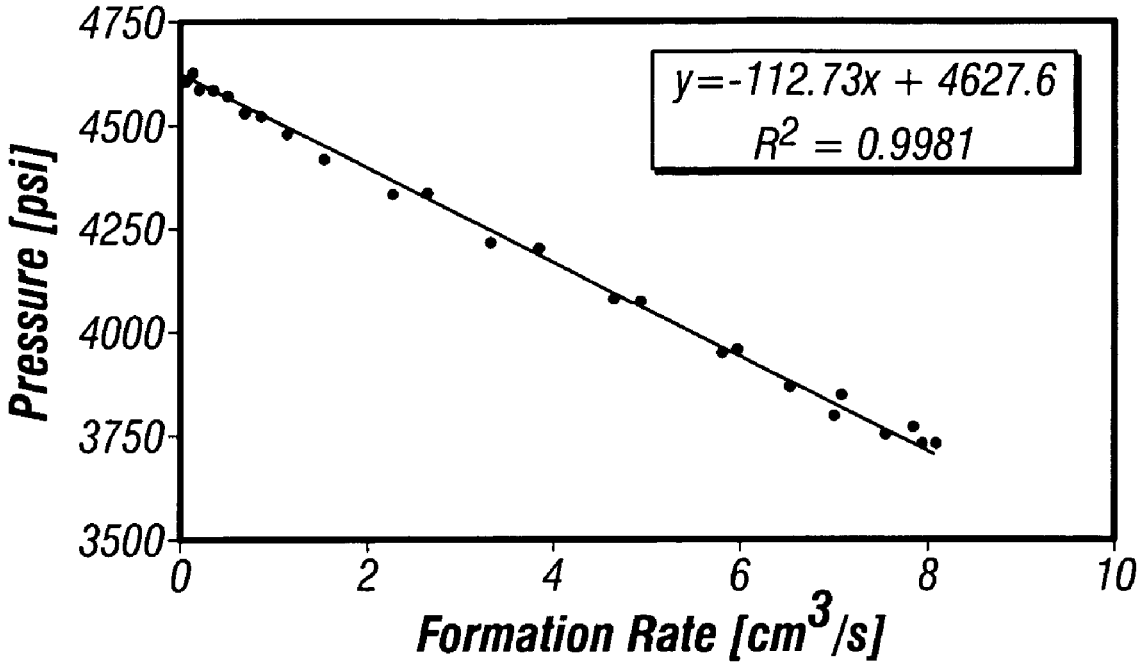
FIG. 3 is a graph to illustrate formation testing using flow rate.

Now that the tool and general test procedure have been described, methods of testing the formation for various parameters of interest will now be described in detail. FIG. 3 shows a flow rate plot for use in an analytical technique known as flow rate analysis (FRA). U.S. Pat. No. 5,708,204 to Kasap, which is incorporated herein by reference, describes a basic FRA technique. FRA provides extensive analysis of pressure drawdown and build-up data. The mathematical technique employed in FRA is a form of multi-variant regression analysis. Using multi-variant regression calculations, parameters such as formation pressure (p*), fluid compressibility (C) and fluid mobility (m) can be determined simultaneously when data representative of the build up process are available.

The FRA technique is based on the material balance for the formation test tool flow-line volume with the consideration of pressure and compressibility of the enclosed volume. In equation (1) the standard Darcy equation is shown $$q \approx \frac{k}{\mu} \cdot \Delta p, \quad \text{or} \quad q = \frac{kA}{\mu} \cdot \frac{\Delta p}{L} \tag{1}$$

which establishes the proportional relationship between flow rate (q), permeability (k), dynamic viscosity (μ), and the differential pressure (Δp). The same applies if fluid is flowing through a core with the cross-section surface (A) and the length (L) as in the case of a drill stem test. A key contribution of FRA is to use the formation rate in the Darcy Equation instead of a piston withdrawal rate. The formation rate is calculated by correcting the drawdown piston rate for tool storage effects. Representing the complex flow geometry of probe testing with a geometric factor makes the FRA technique more practical to obtain formation pressure (p*), permeability, and fluid compressibility.

Darcy's equation is expressed with a geometric factor for isothermal, steady-state flow of a liquid when the inertial flow (Forchheimer) resistance is negligible, $$q_f = \frac{kG_o r_i (p^* - p(t))}{\mu}, \tag{2}$$

where $q_f$ is the volumetric flowrate into the probe from the formation, p* is the formation pressure, and p(t) is the pressure in the probe as a function of time. $G_o$ is a geometric factor that accounts for the unique flow geometry near probe including the wellbore. Using this modified Darcy's equation and compressibility equation for the tool storage effect, the material balance equation can be rearranged as:

$$p(t) = p^* - \left(\frac{\mu}{kG_o r_i}\right)\left(C_{sys} V_{sys} \frac{dp(t)}{dt} + q_{dd}\right). \tag{3}$$

The fluid compressibility in the tool flowline is $C_{sys}$, and $V_{sys}$ is the volume of the flowline. Note that the terms within the last parentheses in Eq. 3 correspond to accumulation and piston drawdown rates ($q_{dd}$), respectively. These rates act against each other during a drawdown period and together during a buildup period, but in essence the combination is the flow rate from the formation. Eq. 3 is an instantaneous Darcy's equation utilizing the piston rate but corrected to achieve the formation rate. The correction constitutes the important feature of the FRA method. A plot of p(t) versus the formation rate, given in Eq. 3 as the term in parentheses, should result in a straight line with a negative slope and intercept at p*.

The methods described herein utilize certain aspects of the known FRA techniques, and provide improved testing and reduced test time through real time verification. In one aspect, verification is performed by multiple draw cycles, while in other aspects a single draw cycle is used and self verified.

According to the present invention, a quality indicator or factor $R^2$ is derived from a best straight-line fit to the FRA data. The quality indicator is derived analytically using, for example, a least squares method to determine how well the data points fit the straight line. The quality indicator is preferably a dimensionless number between 0 and 1. Currently, a quality indicator of about 0.95 or higher is considered indicative of a good test for verification purposes.

During a single cycle of a drawdown test using the methods of the present invention, formation flow rate can be measured in cubic centimeters per second (cm3/s). Pressure response of the system volume 204 in the case of large volume systems or test volume 204 is influenced by fluid flow from the formation. The pressure response is measured in pounds per square inch (psi) or in bars (bar) using the sensor 206. Pressure response curves can be plotted or otherwise collected electronically to obtain multiple data points for use with multiple regression analysis techniques.

The method of the present invention enables determinations of mobility (m), fluid compressibility (C) and formation pressure (p*) to be made during the drawdown portion of the cycle by varying the draw rate of the system between the drawdown portions. This early determination allows for earlier control of drilling system parameters based on the calculated p*, which improves overall system performance and control quality. According to the present invention, the same determinations are used for optimizing subsequent tests or test portions by using the information to set control parameters used by the controller 210 in controlling speed, volume, delta pressure and piston position in the draw down unit 202.

One method according to the present invention utilizes the capability of a closed loop draw down system as described above and shown in FIG. 2 to optimize successive test cycles or test portions in making determinations of formation parameters.

A preferred method using either FRA methods or variable draw rates as described above includes separating either a single cycle or multiple test cycles into successive test portions. A test is initiated and formation parameters, e.g., pressure, mobility, compressibility and test quality indicators are determined during the first test portion. The first test portion might be a draw down portion to determine compressibility, for example, or the first test portion might include a draw and build-up cycle to determine a first iteration of formation pressure.

The determinations made during the first test portion are then used to set test parameters used by the draw down unit 200 to conduct more efficiently the succeeding test portion. In previous methods using successive tests or test portions, each successive test portion is typically undertaken with predetermined values for draw period, volume change rate, delta-pressure, etc. The present invention determines next-step parameters in real-time using the down hole processor in the controller 210 based in part on measurements and determinations in the immediately preceding test portion.

Test Options

The present invention provides the capability to perform different test methods to enable test verification by altering the test method for a particular draw down test. The apparatus can also be programmed to perform a standard draw down test, which can then be verified by subsequent cycles initiated according to the present invention. Exemplary options without limiting the scope of the present invention include 1) a standard test using a drawdown and build-up test with fixed volume and rate within a defined test duration, 2) repeated drawdown and buildup tests with different drawdown rates, and 3) successive drawdown tests with different rates followed by a pressure buildup. All tests can terminate when a predetermined time window is exceeded or when the pressure buildup is decreasing under a given rate.

Figure 4A:
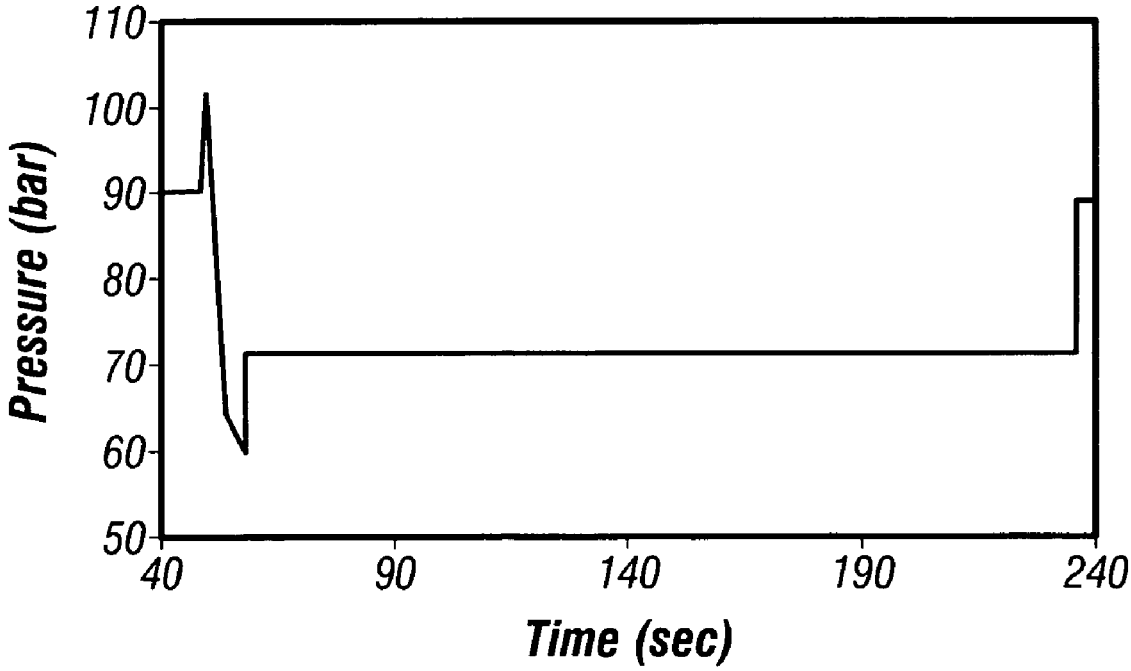
FIG. 4A shows a standard draw down test cycle.
Figure 4B:
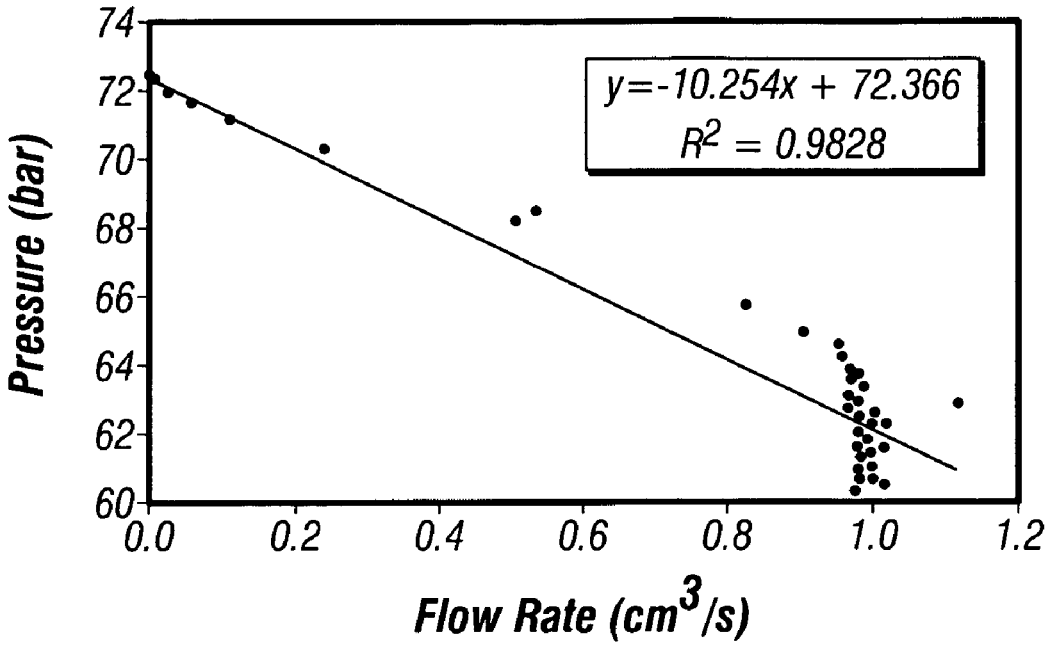
FIG. 4B shows a flow rate plot associated with the standard draw down test cycle of FIG. 4A along with a quality indicator according to the present invention.
Figure 4C:
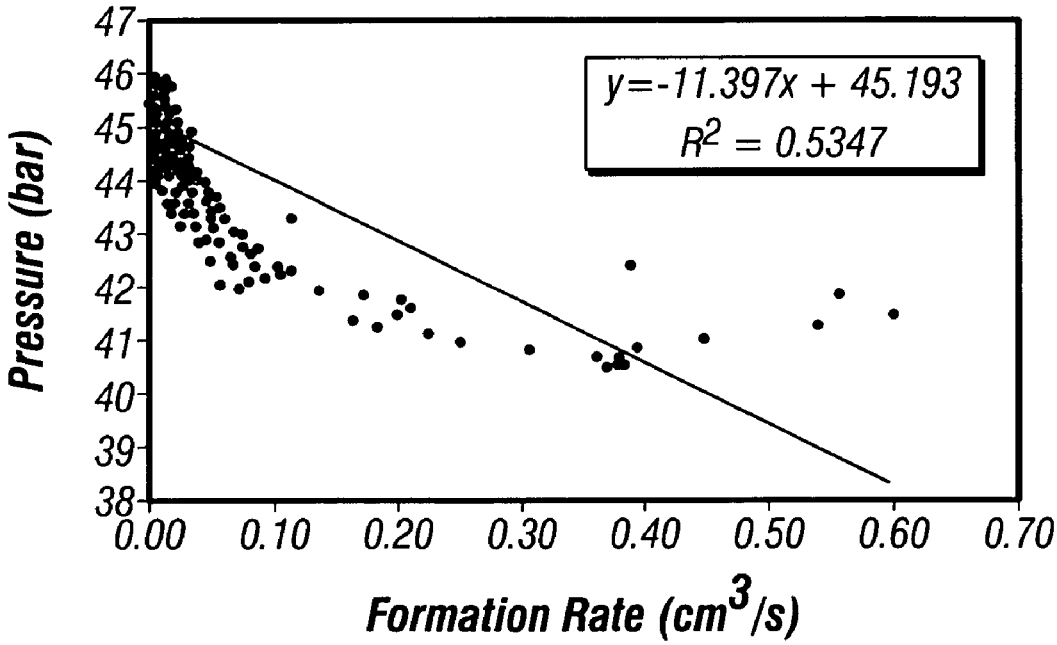
FIG. 4C is an example of a test having a low quality indicator.

FIGS. 4A-B show test-derived plots of a standard draw down test. FIG. 4A shows a plot of pressure vs. time of a single draw cycle. FIG. 4B shows pressure vs. flow rate. A quality indicator of 0.98 is indicated by this particular data set, thus the test would be considered a good test. FIG. 4C shows another test-derived flow rate plot to show the result of a test having a low quality indicator.

Optimized Repeat Test

The optimized repeated drawdown and buildup test includes performing several draw cycle tests in sequence and comparing the resultant pressures for repeatability. If the buildup pressures are not reading the correct formation pressure, then the pressures will not repeat within an acceptable margin (generally less than the gauge repeatability). During the repeat tests, different drawdown rates can be used based on the down hole analysis results of the prior test. The down hole control system analyzes each pressure test result with Formation Rate Analysis and optimizes the drawdown rate, volume, and buildup durations based on the FRA quality indicator and determined formation mobility. Such repeat tests validate the tests. If the buildup criteria are met in conjunction with an acceptable quality indicator, the test can be aborted early to avoid unnecessary cycles and to reduce the test times.

Figure 5A:
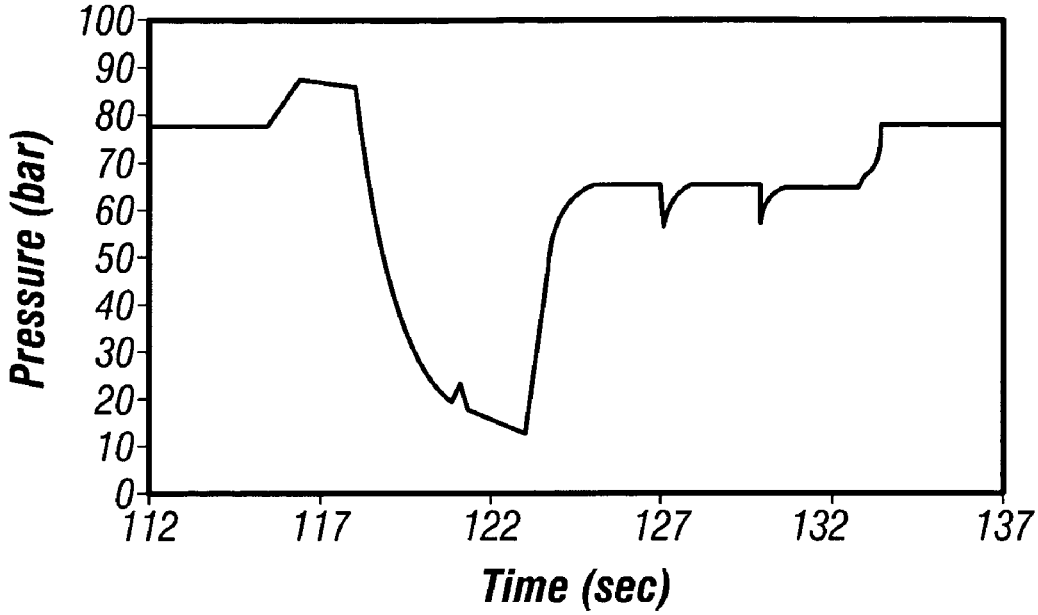
FIGS. 5A-B show one method of formation testing according to the present invention using multiple draw cycles.
Figure 5B:
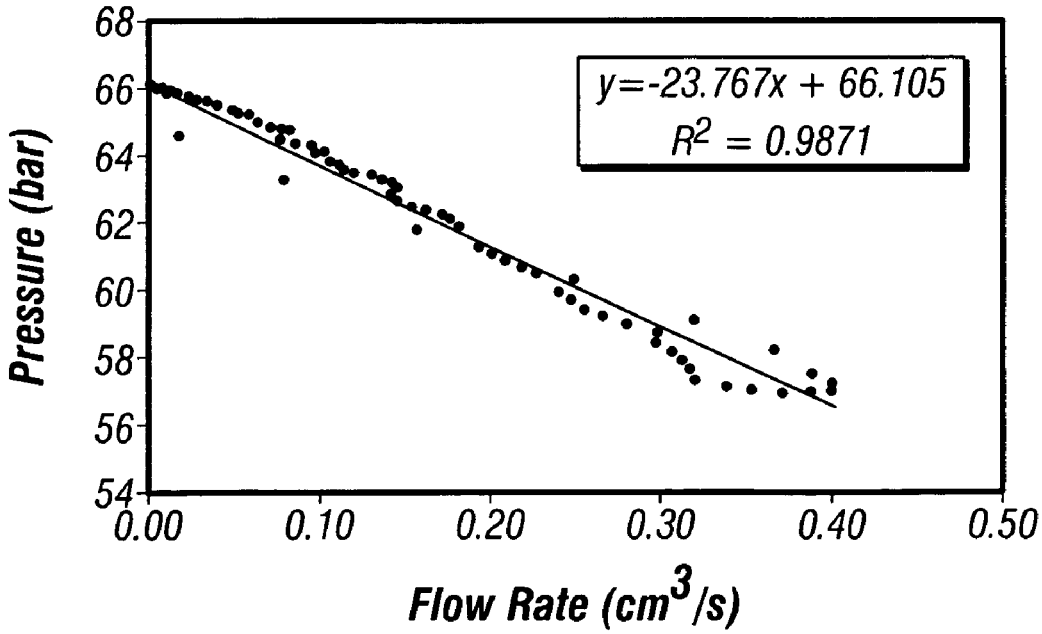

FIGS. 5A-5B show test-derived plots of an optimized repeat draw down test according to the present invention. Note that parameters for each test portion following an initial test portion have been modified to reduce the delta pressure between the tool and formation pressure. This procedure optimizes the succeeding tests by reducing build-up time. Furthermore, the draw rate in each succeeding test is optimized based on the initial test portion to ensure the draw rate does not exceed the bubble point of the fluid.

Successive Drawdown

Another method according to the present invention provides successive drawdowns prior to a buildup test. The successive draw downs are preferably performed with different draw rates followed by a pressure buildup test portion. Hence, in this type of test there is only one formation pressure reading. An advantage of this test procedure is to ensure communication with the formation during drawdowns. If the probe or pad seal 126 is securely connected to the formation during the all successive drawdown test portions, then the FRA plot of the entire test set will generate a single straight line. Even though drawdown rates are different, the tests will respond to the same formation mobility, and the slope of the FRA plot will be the same for the different drawdown rates. Moreover, the resultant buildup will lead to the formation pressure with more confidence after verifying the seal and flow rates through the draw down portions.

Figure 6A:
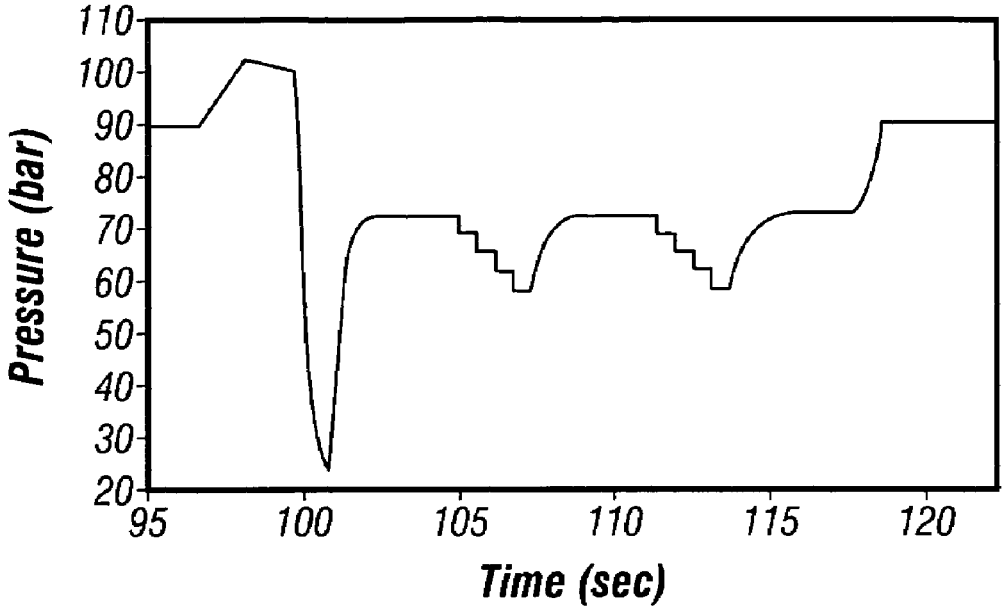
FIGS. 6A-B illustrate another method of formation testing according to the present invention using multiple draw cycles and stepped-draw down.
Figure 6B:
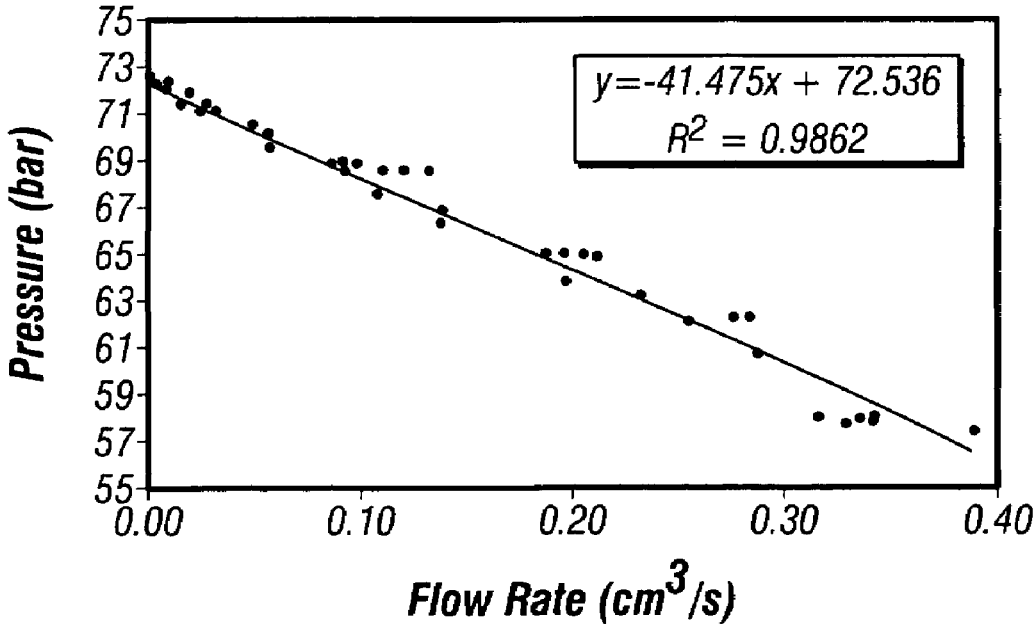

FIGS. 6A-6B show test-derived plots of one version of the successive draw down test as described above. The initial draw here is shown as a standard draw test. This happens to be the protocol used for this particular test. A standard draw down cycle for the initial test portion, however, is not required. The second test portion of the plot in FIG. 6A a variation of the successive draw down test whereby each successive draw down provides a portion with substantially steady-state flow. The overall draw down portion then looks like a single stair-stepped draw down. The flow rate plot of FIG. 6B is based on the test of FIG. 6A. FIG. 6B shows that the flow rate data points between the test start and end points are much more numerous than in the standard draw cycle of FIG. 4B. Thus, the straight-line fit more accurately represents the data and the quality indicator 0.9862 is slightly higher as well.

The above-described methods are exemplary of tests associated with the present invention and are not intended to limit the scope or the present method or to exclude other test options. For example the first test portion can include the controller might utilize signals from either the sensors 220 to determine a tool characteristic such as piston speed, position or test volume pressure, and/or the controller could utilize signals from the formation property sensor 206 to determine a formation characteristic during the first test portion to set test parameters for the second test portion. Then, the second test portion can include using signals from either the tool sensors 220 or formation property sensor 206 to determine a second characteristic, tool and/or formation, during the second test portion. Then the processor in the controller 210 can evaluate the characteristics using FRA or other useful technique to determine a desired formation parameter, e.g., pressure, compressibility, flow rate, resistivity, dielectric, chemical properties, neutron porosity etc., depending on the particular sensor or sensors selected.

Figure 7A:
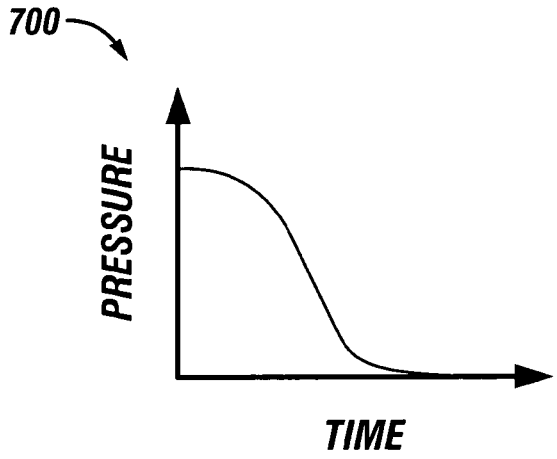
FIGS. 7A-E illustrate another method of formation testing according to the present invention using smooth draw down created by continuously increasing draw rate.
Figure 7B:
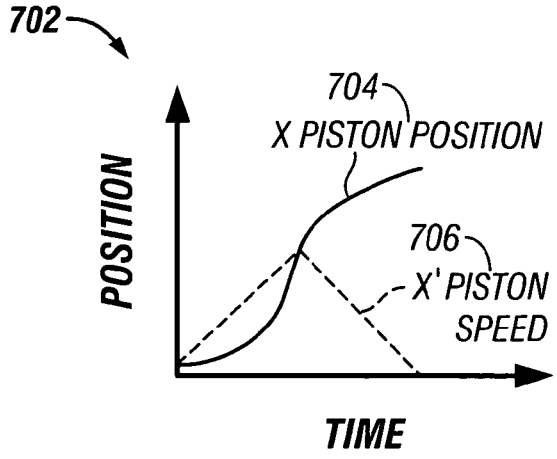

FIGS. 7A-E illustrate another method of formation testing according to the present invention using smooth draw down created by continuously increasing draw rate during a first draw portion and then continuously decreasing the draw rate (piston speed) for a second draw portion. Referring now to FIGS. 2 and 7A-B, the smooth draw down of illustrated in FIG. 7A is accomplished by monitoring and controlling the test volume 204.

In one embodiment, the test volume is controlled by controlling the speed of the piston 208 shown in FIG. 2. The volume can be controlled by other devices, however, without departing from the scope of the present invention. For example, the test volume 204 might be controlled by a variable rate pump rather than the piston 208. Those skilled in the art would understand that FIG. 2 and item 208 could be construed as schematically indicating a variable rate pump 208 without further illustration, because the control circuitry in controller 210 would not be functionally changed substantially from the controller shown. Thus, references to the piston speed or pump rate herein are used interchangeably. Those skilled in the art would understand that changing speed of a piston would have the same effect as changing the pump rate of a variable rate pump with respect to changing the effective volume and/or pressure of the test volume 204.

FIG. 7B illustrates one method of creating a smooth draw down pressure curve 700 as shown in FIG. 7A. The method includes bringing the test volume 204 into communication with a formation for testing. Any conventional sealing device such as a pad or packer is sufficient to isolate the formation from annular fluids and pressure of return fluid. The test volume is monitored by the sensor 206 and the volume 204 is controlled by controlling the draw piston or variable rate pump 208.

Piston position is illustrated in FIG. 7B by line x 704, and piston speed is indicated by dashed line x' 706. The method includes increasing the speed of the piston in a continuous fashion during a first draw portion and then decreasing the piston in a continuous fashion during a second draw portion. This continuous draw rate change will result in a pressure-time response in the test volume 204 as shown in FIG. 7A.

The method of the present invention further includes analyzing the test volume using multi-regression or other formation rate analyses to determine formation parameters by measuring characteristics of the test volume 204 and/or the tool. The measured characteristics are then analyzed according to the techniques described above and/or by using the equations 1-3 to determine formation parameters such as pressure, mobility, permeability, fluid compressibility, and fluid viscosity.

Figure 7C:
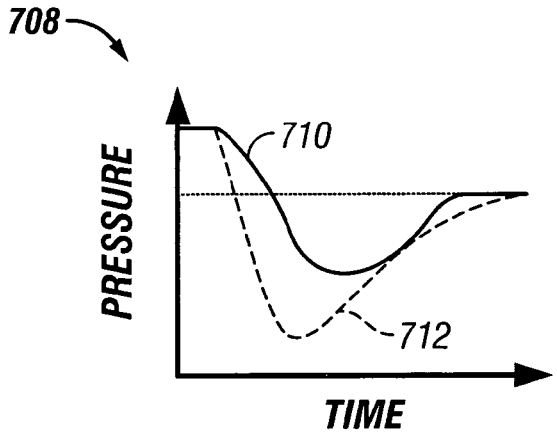

FIG. 7C shows a pressure-time plot 708 of a draw down cycle using the smooth draw down just described. A plot according to standard methods is shown as dashed line 712, while the solid line 712 illustrates a pressure curve generated by the present method. It is apparent that the curve produced by the present method has less of a slope during the pressure decrease portion. The smooth draw down also results in a higher minimum pressure and a shorter time to stabilization pressure. A benefit of these curve characteristics is shown by comparing measurement plots of the smooth draw down curve 710 to the standard draw down 712.

Figure 7D:
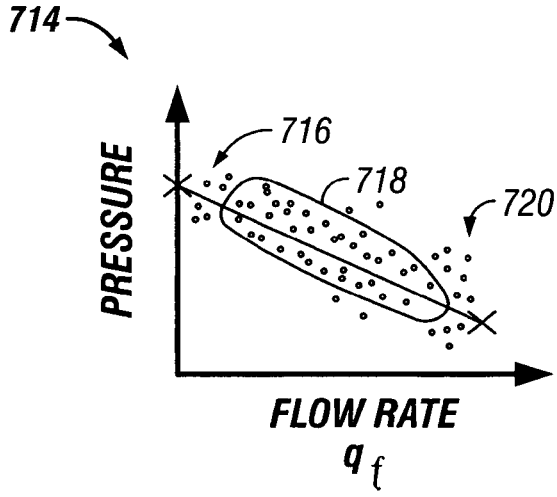
Figure 7E:
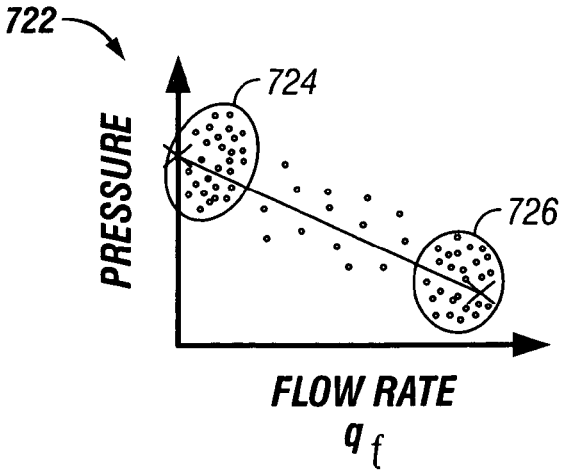

FIG. 7D shows a pressure-flow rate plot 714 resulting from the smooth draw down curve 710, and FIG. 7E illustrates a pressure-flow rate plot 722 resulting from the standard draw down curve 712. Note that pressure data points 718 are evenly distributed between the test start point 716 and end point 720 for the smooth draw down test. Pressure data points generated using the standard test, however, are generally clustered into two groups 724, 726 about the start and end points.

Figure 8A:
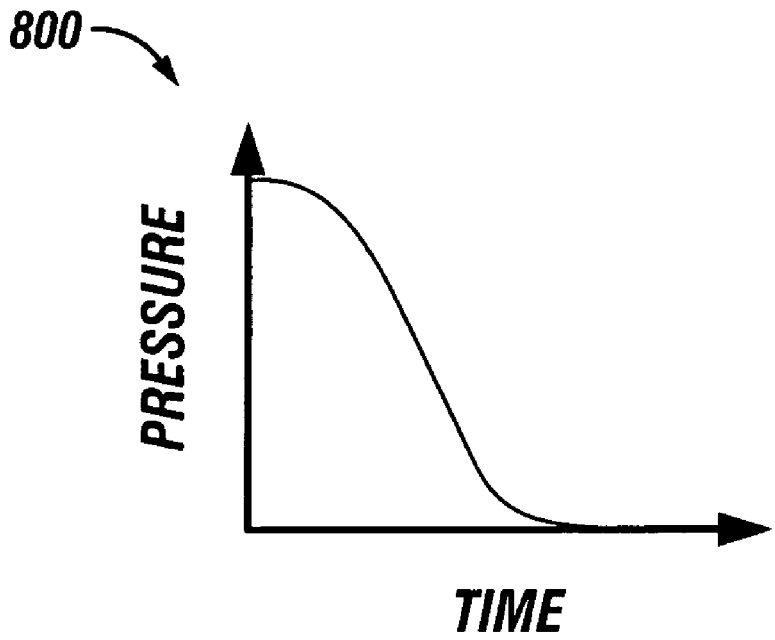
FIGS. 8A-B illustrate another method of formation testing according to the present invention using smooth draw down created by increasing draw rate in a step-wise manner.
Figure 8B:
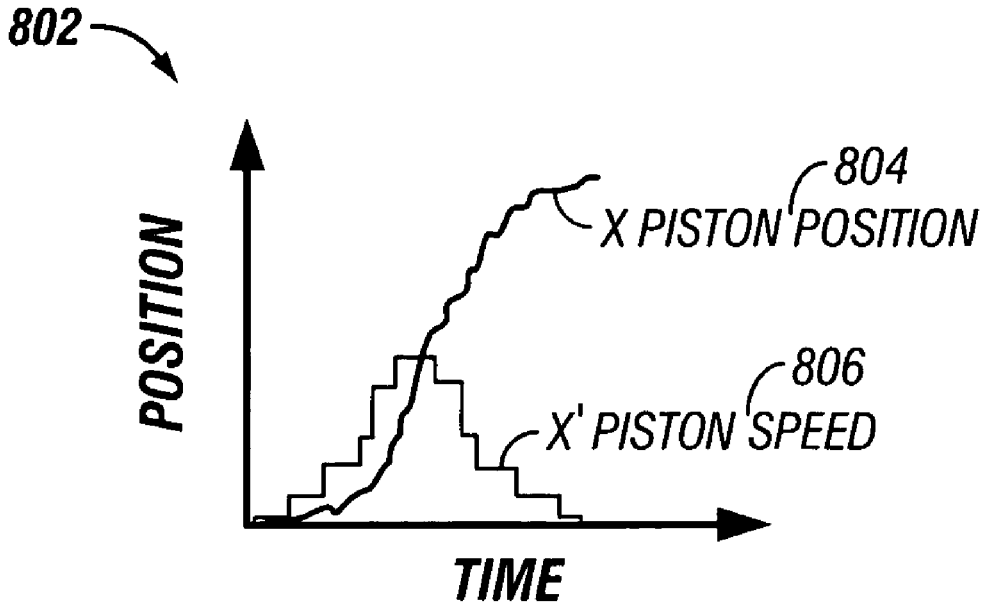

FIGS. 8A-B illustrate another method of formation testing according to the present invention using a stepped approach to reducing pressure in the test volume 204. FIG. 8B shows a combined plot 802 of piston speed 806 and piston position 804 with respect to time. The piston is preferably controlled using a feedback control circuit as described above and shown in FIG. 2. This method is comparable to the smooth draw down method described above and shown in FIGS. 7A-D in that this stepped method increases the draw rate throughout a first draw portion and then decreases the draw rate through a second portion. The affect on test volume pressure using the stepped approach is substantially similar to the smooth draw down where the pressure is continuously decreased. A pressure-time plot 800 resulting from a stepped approach is shown in FIG. 8A. Increasing the draw rate throughout the first portion of the draw cycle using the stepped approach produces pressure-time and pressure-flow rate data results substantially similar to those of FIGS. 7C-D, and thus are not reproduced here.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

What is claimed is:

1. A method of determining in situ a desired formation parameter of interest comprising:

a) conveying a tool into a well borehole traversing a formation;

b) establishing fluid communication between the tool and the formation, the tool having a test volume for accepting fluid from the formation;

c) drawing fluid into the test volume, the drawing including a first draw portion and a second draw portion;

d) controlling a draw rate during at least one of the first draw portion and the second draw portion, the draw rate being controlled according to one or more of i) increasing the draw rate a plurality of times during the first draw portion, and ii) decreasing the draw rate a plurality of times during the second draw portion, wherein increasing the draw rate includes at least one of i) increasing the draw rate continuously during the first draw portion and ii) increasing the draw rate in a step-wise manner during the first draw portion; and e) determining at least one characteristic of the test volume during one or more of the first draw portion and the second draw portion, the determined characteristic being indicative of the formation parameter of interest.

2. The method of claim 1, wherein the borehole is deviated from vertical, the tool further including a pad sealing element for establishing fluid communication between the tool and the formation, the method further comprising performing a tool face measurement to provide an indication that the pad sealing element is not pushed against the formation where a cutting bed is located.

3. The method of claim 1, wherein controlling the draw rate includes pumping fluid from the test volume using a variable rate pump.

4. The method of claim 1, wherein determining at least one characteristic includes determining a first characteristic during the first draw portion and determining a second characteristic during the second draw portion.

5. The method of claim 1, wherein determining the at least one characteristic includes determining one or more of i) a draw rate; ii) a piston rate; iii) a piston position; a pump rate; iv) a fluid compressibility; v) a flow rate from the test volume; vi) a flow rate into the test volume; vii) pressure of the test volume; viii) temperature in the test volume; ix) volume of the test volume; and x) composition of fluid in the test volume.

6. The method of claim 1, wherein establishing fluid communication includes exposing a port in the tool to a sealed portion of the borehole.

7. The method of claim 6 further comprising sealing a portion of the borehole using one or more of i) a packer sealing an annular portion of the borehole and ii) an extendable probe sealing a wall portion of the borehole.

8. The method of claim 1 wherein controlling the draw rate includes varying the volume of the test volume.

9. The method of claim 8, wherein varying the volume includes using a piston to vary the volume.

10. The method of claim 1 further comprising:

i) changing the draw rate when the test volume pressure is below a formation pressure to allow pressure in the test volume to increase toward the formation pressure; and ii) determining a second characteristic of the test volume during at least one of A) while pressure in the test volume is increasing; and B) when the pressure in the test volume stabilizes.

11. The method of claim 10, wherein changing the draw rate is selected from one of i) changing the draw rate to substantially zero draw rate; and ii) decreasing the rate of increase in draw rate such that flow from the formation is equal to or greater than the draw rate.

12. A method of determining in situ a desired formation parameter of interest comprising:

a) conveying a tool into a well borehole traversing a formation;

b) establishing fluid communication between the tool and the formation, the tool having a test volume for accepting fluid from the formation;

c) drawing fluid into the test volume, the drawing including a first draw portion and a second draw portion;

d) controlling a draw rate during at least one of the first draw portion and the second draw portion, and e) determining at least one characteristic indicative of the formation parameter of interest during one or more of the first draw portion and the second draw second draw portion, wherein determining the at least one characteristic includes using formation rate analysis at least in part to determine the at least one characteristic.

13. The method of claim 12, wherein the formation rate analysis comprises determining the draw rate and compressibility of fluid in the test volume.

14. A method of determining in situ a desired formation parameter of interest comprising:

a) conveying a tool into a well borehole traversing a formation;

b) establishing fluid communication between the tool and the formation, the tool having a test volume for accepting fluid from the formation;

c) drawing fluid into the test volume, the drawing including a first draw portion and a second draw portion;

d) controlling a draw rate during at least one of the first draw portion and the second draw portion, and e) determining at least one characteristic indicative of the formation parameter of interest during one or more of the first draw portion and the second draw portion, wherein decreasing the draw rate includes at least one of i) decreasing the draw rate continuously during the second draw portion and ii) decreasing the draw rate in a step-wise manner during the second draw portion.

15. An apparatus for determining in situ a desired formation parameter of interest comprising:

a) a tool conveyable into a well borehole traversing a formation;

b) a test unit in the tool, the test unit being adapted for fluid communication with the formation, the test unit including a test volume for receiving fluid from the formation;

c) a control device associated with the test volume for controlling a draw rate of the fluid being drawn into in the test volume, the control device being operable to control the draw rate according to one or more of i) increasing the draw rate a plurality of times during a first draw portion, and ii) decreasing the draw rate a plurality of times during a second draw portion, wherein the control device increases the draw rate by at least one of i) increasing the draw rate continuously during the first draw portion and ii) increasing the draw rate in a step-wise manner during the first draw portion; and d) a sensing device for determining at least one characteristic of the test volume during one or more of the first draw portion and the second draw portion, the determined characteristic being indicative of the formation parameter of interest.

16. The apparatus of claim 15, wherein the tool is conveyed in the borehole on one of i) a drill string; ii) a coiled tube; and iii) a wireline.

17. The apparatus of claim 15, wherein the control device includes a variable rate pump for drawing fluid into the test volume.

18. The apparatus of claim 15, wherein the at least one sensed characteristic is a first characteristic sensed during the first draw portion and a second characteristic sensed during the second draw portion.

19. The apparatus of claim 15, wherein the at least one characteristic includes one or more of i) a draw rate; ii) a piston rate; iii) a piston position; a pump rate; iv) a fluid compressibility; v) a flow rate from the test volume; vi) a flow rate into the test volume; vii) pressure of the test volume; viii) temperature in the test volume; ix) volume of the test volume; and x) composition of fluid in the test volume.

20. The apparatus of claim 15, wherein the test unit further includes a port exposed to a sealed portion of the borehole for establishing the fluid communication.

21. The apparatus of claim 20 further comprising one or more of i) a packer for sealing an annular portion of the borehole and ii) an extendable probe sealing a wall portion of the borehole.

22. The apparatus of claim 15 further comprising a controller associated with the control device for changing the draw rate when a test volume pressure is below a formation pressure to allow pressure in the test volume to increase toward the formation pressure, the sensing device determining a second characteristic of the test volume during at least one of A) while pressure in the test volume is increasing; and B) when the pressure in the test volume stabilizes.

23. The apparatus of claim 22, wherein the control device changes the draw rate by i) changing the draw rate to a substantially zero draw rate; and ii) decreasing a rate of increase in draw rate such that flow from the formation is equal to or greater than the draw rate.

24. An apparatus for determining in situ a desired formation parameter of interest comprising:

a) a tool conveyable into a well borehole traversing a formation;

b) a test unit in the tool, the test unit including a test volume for receiving fluid from the formation;

c) a control device associated with the test volume controlling a draw rate of the fluid being drawn into in the test volume, the control device being operable to control the draw rate according to one or more of i) increasing the draw rate during a first draw portion, and ii) decreasing the draw rate during a second draw portion;

d) a sensing device for determining at least one characteristic indicative of the formation parameter of interest during one or more of the first draw portion and the second draw portion;

wherein the test volume comprises a variable volume and the control device controls the draw rate by varying the volume of the variable volume.

25. The apparatus of claim 24 further comprising a piston in the control device for varying the volume of the variable volume.

26. An apparatus for determining in situ a desired formation parameter of interest comprising:

a) a tool conveyable into a well borehole traversing a formation;

b) a test unit in the tool, the test unit including a test volume for receiving fluid from the formation;

c) a control device associated with the test volume controlling a draw rate of the fluid being drawn into in the test volume, the control device being operable to control the draw rate according to one or more of i) increasing the draw rate during a first draw portion, and ii) decreasing the draw rate during a second draw portion;

d) a sensing device for determining at least one characteristic indicative of the formation parameter of interest during one or more of the first draw portion and the second draw portion; and e) a processor processing an output of the sensing device using a formation rate analysis program to determine the at least one characteristic.

27. The apparatus of claim 26, wherein received output includes the draw rate and compressibility of fluid in the test volume.

28. An apparatus for determining in situ a desired formation parameter of interest comprising:

a) a tool conveyable into a well borehole traversing a formation;

b) a test unit in the tool, the test unit including a test volume for receiving fluid from the formation;

c) a control device associated with the test volume controlling a draw rate of the fluid being drawn into in the test volume, the control device being operable to control the draw rate according to one or more of i) increasing the draw rate during a first draw portion, and ii) decreasing the draw rate during a second draw portion;

d) a sensing device for determining at least one characteristic indicative of the formation parameter of interest during one or more of the first draw portion and the second draw portion;

wherein the control device decreases the draw rate by at least one of i) decreasing the draw rate continuously during the second draw portion and ii) decreasing the draw rate in a step-wise manner during the second draw portion.

29. A system for determining in situ a desired formation parameter of interest comprising:

a) a work string for conveying a tool into a well borehole traversing a formation;

b) a test unit in the tool, the test unit being adapted for fluid communication with the formation, the test unit including a test volume for receiving fluid from the formation;

c) a control device associated with the test volume for controlling a draw rate of the fluid being drawn into in the test volume, the control device being operable to control the draw rate according to one or more of i) increasing the draw rate a plurality of times during a first draw portion, and ii) decreasing the draw rate a decreasing the draw rate a plurality of times during a second draw portion, wherein the control device increases the draw rate by at least one of i) increasing the draw rate continuously during the first draw portion and ii) increasing the draw rate in a step-wise manner during the first draw portion;

d) a sensing device for determining at least one characteristic of the test volume during one or more of the first draw portion and the second draw portion;

e) a processor receiving an output of the sensing device, the processor processing the received output according to programmed instructions, the formation parameter of interest being determined at least in part by the processed output.

30. The system of claim 29, wherein the work string is selected from a group consisting of i) a drill string; ii) a coiled tube; and iii) a wireline.

31. The system of claim 29, wherein the control device includes a variable rate pump for drawing fluid into the test volume.

32. The system of claim 29, wherein at least one characteristic includes a first characteristic determined during the first draw portion and a second characteristic determined during the second draw portion.

33. The system of claim 29, wherein the at least one characteristic includes one or more of i) a draw rate; ii) a piston rate; iii) a piston position; a pump rate; iv) a fluid compressibility; v) a flow rate from the test volume; vi) a flow rate into the test volume; vii) pressure of the test volume; viii) temperature in the test volume; ix) volume of the test volume; and x) composition of fluid in the test volume.

34. The system of claim 29 further comprising a controller associated with the control device for changing the draw rate when the test volume pressure is below a formation pressure to allow pressure in the test volume to increase toward the formation pressure, the sensing device determining a second characteristic of the test volume during at least one of A) while pressure in the test volume is increasing; and B) when the pressure in the test volume stabilizes.

35. The system of claim 34, wherein the control device changes the draw rate by i) changing the draw rate to substantially zero draw rate; and ii) decreasing the rate of increase in draw rate such that flow from the formation is equal to or greater than the draw rate.

36. The system of claim 29, wherein the test unit further includes a port exposed to a sealed portion of the borehole for establishing the fluid communication.

37. The system of claim 36 further comprising one or more of i) a packer for sealing an annular portion of the borehole and ii) an extendable probe sealing a wall portion of the borehole.

38. A system for determining in situ a desired formation parameter of interest comprising:

a) a string conveyable into a well borehole traversing a formation;

b) a test unit in the string, the test unit including a test volume for receiving fluid from the formation;

c) a control device associated with the test volume controlling a draw rate of the fluid being drawn into in the test volume, the control device controlling the draw rate according to one or more of i) increasing the draw rate during a first draw portion, and ii) decreasing the draw rate during a second draw portion;

d) a sensing device for determining at least one characteristic of the test volume during one or more of the first draw portion and the second draw portion;

e) a processor receiving an output of the sensing device, the processor processing the received output according to programmed instructions, the formation parameter of interest being determined at least in part by the processed output, wherein the test volume comprises a variable volume and the control device decreases the pressure of the test volume by varying the volume of the variable volume.

39. The system of claim 38 further comprising a piston in the control device for varying the volume of the variable volume.

40. A system for determining in situ a desired formation parameter of interest comprising:

a) a string conveyable into a well borehole traversing a formation;

b) a test unit in the string, the test unit including a test volume for receiving fluid from the formation;

c) a control device associated with the test volume controlling a draw rate of the fluid being drawn into in the test volume, the control device controlling the draw rate according to one or more of i) increasing the draw rate during a first draw portion, and ii) decreasing the draw rate during a second draw portion;

d) a sensing device for determining at least one characteristic of the test volume during one or more of the first draw portion and the second draw portion;

e) a processor receiving an output of the sensing device, the processor processing the received output according to programmed instructions, the formation parameter of interest being determined at least in part by the processed output, wherein the programmed instructions include a formation rate analysis program to determine the first characteristic.

41. The system of claim 40, wherein received output includes the draw rate and compressibility of fluid in the test volume.

42. A system for determining in situ a desired formation parameter of interest comprising:

a) a string conveyable into a well borehole traversing a formation;

b) a test unit in the string, the test unit including a test volume for receiving fluid from the formation;

c) a control device associated with the test volume controlling a draw rate of the fluid being drawn into in the test volume, the control device controlling the draw rate according to one or more of i) increasing the draw rate during a first draw portion, and ii) decreasing the draw rate during a second draw portion;

d) a sensing device for determining at least one characteristic of the test volume during one or more of the first draw portion and the second draw portion;

e) a processor receiving an output of the sensing device, the processor processing the received output according to programmed instructions, the formation parameter of interest being determined at least in part by the processed output, wherein the control device decreases the draw rate by at least one of i) decreasing the draw rate continuously during the second draw portion and ii) decreasing the draw rate in a step-wise manner during the second draw portion.

* * * * *